US009259031B2

(12) United States Patent
Branton et al.

(10) Patent No.: US 9,259,031 B2
(45) Date of Patent: Feb. 16, 2016

(54) FILTER FOR A SMOKING ARTICLE

(75) Inventors: Peter Branton, London (GB); Martin Duke, London (GB); Stephen Tennison, Basingstoke (GB); Dinah Blanche Winter, London (GB)

(73) Assignee: BRITISH AMERICAN TOBACCO (INVESTMENTS) LIMITED (GB)

( * ) Notice: Subject to any disclaimer, the term of this patent is extended or adjusted under 35 U.S.C. 154(b) by 34 days.

(21) Appl. No.: 14/124,637

(22) PCT Filed: Jun. 1, 2012

(86) PCT No.: PCT/GB2012/051257

§ 371 (c)(1),
(2), (4) Date: Feb. 7, 2014

(87) PCT Pub. No.: WO2012/168699

PCT Pub. Date: Dec. 13, 2012

(65) Prior Publication Data

US 2014/0137881 A1 May 22, 2014

(30) Foreign Application Priority Data

Jun. 6, 2011 (GB) ..... 1109419.0
Dec. 6, 2011 (GB) ..... 1120926.9

(51) Int. Cl.
*A24D 3/02* (2006.01)
*A24D 3/06* (2006.01)
*A24D 3/16* (2006.01)

(52) U.S. Cl.
CPC ..... *A24D 3/066* (2013.01); *A24D 3/0275* (2013.01); *A24D 3/062* (2013.01); *A24D 3/163* (2013.01)

(58) Field of Classification Search
USPC ..... 493/39, 46, 42, 43; 131/331, 339
See application file for complete search history.

(56) References Cited

U.S. PATENT DOCUMENTS

| | | | | |
|---|---|---|---|---|
| 5,820,967 | A | 10/1998 | Gadkaree | |
| 6,814,786 | B1 * | 11/2004 | Zhuang et al. | 96/131 |
| 7,160,366 | B2 * | 1/2007 | Blackburn | B01J 20/28095 96/108 |
| 2004/0194792 | A1 | 10/2004 | Zhuang et al. | |
| 2005/0133051 | A1 | 6/2005 | Luan et al. | |
| 2005/0133054 | A1 | 6/2005 | Fournier et al. | |
| 2006/0144412 | A1 | 7/2006 | Mishra et al. | |

(Continued)

FOREIGN PATENT DOCUMENTS

| | | | |
|---|---|---|---|
| CA | 885796 | A | 11/1971 |
| CA | 2330782 | A1 | 7/2002 |
| CN | 101433818 | A | 5/2009 |

(Continued)

OTHER PUBLICATIONS

Definition of "throughout", the Free Merriam-Webster Dictionary, [online], no date, retrieved from the Internet, [retrieved Mar. 7, 2015], <URL: http://www.merriam-webster.com/dictionary/throughout>.*

(Continued)

*Primary Examiner* — Dennis Cordray
(74) *Attorney, Agent, or Firm* — Cantor Colburn LLP

(57) ABSTRACT

A filter for a smoking article comprises a monolith. The monolith is produced forming particles of a partially cured resin into a dough, shaping the dough to produce a monolith, sintering the particles, carbonizing and activating the sintered monolith, and incorporating the monolith into a smoking article filter.

23 Claims, 5 Drawing Sheets

(56) References Cited

U.S. PATENT DOCUMENTS

| | | | |
|---|---|---|---|
| 2006/0201524 | A1 | 9/2006 | Zhang et al. |
| 2008/0110470 | A1 | 5/2008 | Zhuang et al. |

FOREIGN PATENT DOCUMENTS

| | | | |
|---|---|---|---|
| DE | 2940535 | A1 | 10/1980 |
| EP | 0254551 | A1 | 1/1988 |
| EP | 0585016 | A1 | 3/1994 |
| JP | 06064983 | A | 3/1994 |
| JP | 2009191148 | A | 8/2009 |
| WO | 0130184 | A1 | 5/2001 |
| WO | 03008068 | A1 | 1/2003 |
| WO | 2004086888 | A2 | 10/2004 |
| WO | 2004087309 | A1 | 10/2004 |
| WO | 2006048766 | A1 | 5/2006 |
| WO | 2006070291 | A2 | 7/2006 |
| WO | 2006072889 | A1 | 7/2006 |
| WO | 2006089404 | A1 | 8/2006 |
| WO | 2006097852 | A1 | 9/2006 |
| WO | 2006/109189 | A1 | 10/2006 |
| WO | 2006103404 | A1 | 10/2006 |
| WO | 2007031876 | A2 | 3/2007 |
| WO | 2007036814 | A2 | 4/2007 |
| WO | 2007069093 | A2 | 6/2007 |

OTHER PUBLICATIONS

International Search Report and Written Opinion, mailed Sep. 17, 2012 for PCT/GB2012/051257, filed Jun. 1, 2012.

Written Opinion of the IPEA, mailed May 29, 2013 for PCT/GB2012/051257, filed Jun. 1, 2012.

International Preliminary Report on Patentability, mailed Jul. 12, 2013 for PCT/GB2012/051257, filed Jun. 1, 2012.

* cited by examiner

FILTER FOR A SMOKING ARTICLE

CLAIM FOR PRIORITY

This application is a National Stage Entry entitled to and hereby claiming priority under 35 U.S.C. §§365 and 371 to corresponding PCT Application No. PCT/GB2012/051257, filed Jun. 1, 2012, which in turn claims priority to British Patent Application No. GB1109419.0, filed Jun. 6, 2011, and which also claims priority to British Patent Application No. GB1120926.9, filed Dec. 6, 2011. The entire contents of the aforementioned applications are herein expressly incorporated by reference.

The present invention relates to filters for smoking articles.

Adsorption is a physical or chemical phenomenon during which molecules present in a liquid, vapour or gas attach themselves to the surface of a solid.

Carbon materials are widely used as general purpose industrial adsorbents. They are manufactured from a variety of materials, which may be natural materials (such as wood, peat, coal, petroleum pitch, or nut shells such as coconut), or may be synthetic materials (produced, for example by the carbonization of organic resins).

Carbon materials may be treated in order to increase their surface areas by a process known as activation. Activation may be effected, for example by heating carbon that has been treated with phosphoric acid or zinc chloride, or by heating the carbon with steam or with carbon dioxide. Activation by carbon dioxide is sometimes followed by an additional air modification step, which involves heating the carbon in air. The activation process removes material from the surface of carbon particles resulting in a reduction in weight, the weight loss being proportional to the period of the treatment.

The surface chemistry of carbon materials can be modified to optimise the adsorption of target substances. In particular, the pore structure and state of activation of activated carbon materials are important in determining the efficiency and selectivity of adsorption.

The surface properties of activated carbon materials may be controlled by selection of the process and conditions by which the activated carbon is produced.

Generally, the larger the surface area of a porous material, the greater is the adsorption capacity of the material. However, as the surface area of the material is increased, the density and the structural integrity are reduced. Furthermore, while the surface area of a material may be increased by increasing the number of pores and making the pores smaller, as the size of the pores approaches the size of the target molecule, it is less likely that the target molecules will enter the pores and adsorb to the material. This is particularly true as the flow rate of the material being filtered is increased relative to the activated carbon material. Frequently, the adsorption efficiency is reduced as the flow rate is increased.

Activated carbon materials may be incorporated into smoking articles and smoke filters in order to reduce the level of certain components of the smoke. However, the incorporation of activated carbon material in the form of powder or granules can present difficulties in both the manufacture and use of the smoking article. For example, the amount of particulate activated carbon material for use in each filter must be measured and delivered with high precision, but the irregular shape and size of the particles, and the particle size distribution, may affect the handling of the material which may have relatively poor flow characteristics, and this may create difficulties in metering the delivery of material. Furthermore, particulate activated carbon material may have a high attrition rate, which may lead to the generation of dust during handling. Dust interferes with the manufacturing processes that are used to manufacture filters.

A further disadvantage with granular activated carbon is that as the quantity of material used is increased, the amount of suction that must be applied to draw air through the material (the draw effort or pressure drop) also increases. Thus, the amount of activated carbon that can be used in a smoking article filter is limited by the amount of suction that it is comfortable for the smoker to impart.

According to a first aspect there is provided a smoking article filter comprising a monolith. The monolith comprises carbonized sintered resin.

The monolith may be formed from particles of resin by means of a sintering process, and in this case, the monolith does not comprise a binder. In other words, no additional binder is used to bind the particles of resin together in the formation of the monolith structure.

Sintering is a method in which small particles may be fused together to form solid objects. In comparison to conventional melt processes, when being sintered, the particles are not substantially melted, and retain their original shape and structure. In particular, the pore structure of the particles, e.g. macropores may be substantially retained in the sintered product.

Sintering also differs from conventional moulding processes in which a mouldable composition, comprising particles of a material and a binder, is formed into a desired shape and the shaped material is dried or cured to form a solid object in which the particles are embedded within a matrix formed by the dried or cured binder.

Sintering offers a number of advantages over other methods of forming particles into solid objects. For example, in comparison to melt processes or the use of a binder, sintering favours the formation of a monolith that is free from a binder, which may affect the physical and chemical properties of the monolith. Sintering processes allow the use of very high levels of purity and uniformity in starting materials, highly predictable and consistent results due to the use of controlled starting grain size, and the use of a limited number of process steps and starting materials. In particular, with reference to the monolith of the disclosed smoking article filters, sintering offers the possibility of producing materials having a controlled, uniform porosity, and a unique pore structure characterised by significant macroporosity. These properties would be lost or significantly reduced if the particles were simply melted together or adhered using a binder.

The monolith may comprise a number of channels, which extend throughout the monolith, for example longitudinally, and may be visible to the naked eye.

The channels may be internal to the monolith, in order words, entirely longitudinally encompassed by the material of the monolith. In this case, the channels may be of any desired cross-section. For example the channels may be square, circular, triangular, hexagonal or may have more complex cross sectional shapes, which may be regular or irregular shapes. The internal channels generally extend alongside each other through the monolith in a generally longitudinal direction so that in transverse cross section each channel is revealed as a 'cell' in the monolith. A cell is defined as the distance between the centres of the two opposite walls of a longitudinal channel when viewed in transverse cross section.

The monolith may comprise from 180 to 310 cells per square centimeter, or from 200 to 280 cells per square centimeter. The width of each channel may be from 225-600 μm, preferably from 310-500 μm.

The monolith may in addition, or as an alternative, comprise channels which are external to the monolith, that is, not entirely longitudinally encompassed by the material of the monolith. For example, external channels may take the form of ridges or grooves in the external surface of the monolith. External channels may have any cross sectional shape, which may be a regular or irregular shape. For example, the external channels may be U-shaped or V-shaped. In the case of external channels, when the smoking article filter is in use, smoke may be drawn between the external surface of the monolith channel and the inner face of the plugwrap of the smoking article filter.

According to a second aspect there is provided a smoking article filter comprising a monolith. The monolith comprises a plurality of cells, each cell comprising a channel that extends throughout the monolith, for example, each cell comprising a longitudinal channel that extends throughout the length of the monolith. The combined cross sectional surface area of the channels comprises 30-60%, more particularly 30-40%, even more particularly 32-38%, such as 35%, of the total cross sectional surface area of the monolith.

The combined cross sectional surface area of the channels may comprise about 35% of the total cross sectional surface area of the monolith.

According to a third aspect there is provided a smoking article filter comprising a monolith. The monolith comprises a plurality of cells, each cell comprising a channel that extends throughout the monolith, for example, each cell comprising a longitudinal channel that extends throughout the length of the monolith. In cross section, the monolith comprises 180-310 cells per square centimeter.

The monolith may comprise 200-280 cells per square centimeter.

With regard to any of the above aspects, depending on the desired adsorbency characteristics, the pore structure of the carbon material of the monolith may be predominantly macroporous. Additionally the monolith may include mesopores.

The monolith may have a pore structure that comprises both micropores and macropores.

The carbon material of the monolith may have a BET surface area of up to around 2100 $m^2/g$. For example, the monolith may have a BET surface area of 700-1300 $m^2/g$, such as 810-990 $m^2/g$.

The monolith may be 4-22 mm in length, for example the monolith may be 8-12 mm in length, such as about 10 mm in length.

The smoking article filter may comprise a plurality of monoliths.

A fourth aspect provides a smoking article comprising a smoking article filter of any of the first, second, or third aspects, and in particular, incorporating a monolith which comprises carbonized sintered resin.

A fifth aspect provides the use of a monolith comprising carbonized sintered resin in the filtration of tobacco smoke.

According to a sixth aspect there is provided a method of manufacturing a filter for a smoking article, the method comprising the steps of:

(a) forming particles of partially cured resin into a dough and shaping the dough to produce a monolith;

(b) sintering the particles;

(c) carbonizing and activating the sintered monolith; and, (d) incorporating the monolith into a smoking article filter.

Usually, the particles will be formed by preparing a phenolic resin, partially curing the resin and then comminuting the partially cured resin.

Shaping the dough may comprise extruding the dough. Previously, monoliths have been produced by curing a resin mixture around a fibrous template, which is then decomposed to yield a carbon monolith having channels in the shape of the template. The monoliths used in the disclosed smoking article filters are not formed by the use of a template. Instead, a dough composed of the resin particles, and preferably free from any binder, may be extruded to produce the monolithic structures. In this case, the shapes of the monoliths produced are limited only by the ability to produce the required extrusion die. Consequently, more intricate shapes can be produced, a much greater number of channels can be produced, and the shapes can be easily altered by simply changing the die. There is also no need for a specific decomposition procedure.

The phenolic resin may be obtained by condensing a nucleophilic component with an electrophilic cross-linking agent in the presence of a pore former.

In order that the invention may be better understood, embodiments thereof will now be described, by way of example only, with reference to the accompanying drawings in which.

SMOKING ARTICLE

As used herein, the term "smoking article" includes smokeable products such as cigarettes, cigars and cigarillos whether based on tobacco, tobacco derivatives, expanded tobacco, reconstituted tobacco or tobacco substitutes and also heat-not-burn products (i.e. products in which flavour is generated from a smoking material by the application of heat without causing combustion of the material). Typically, smoking articles are provided with filters for removing constituents from the smoke.

Figure 1:
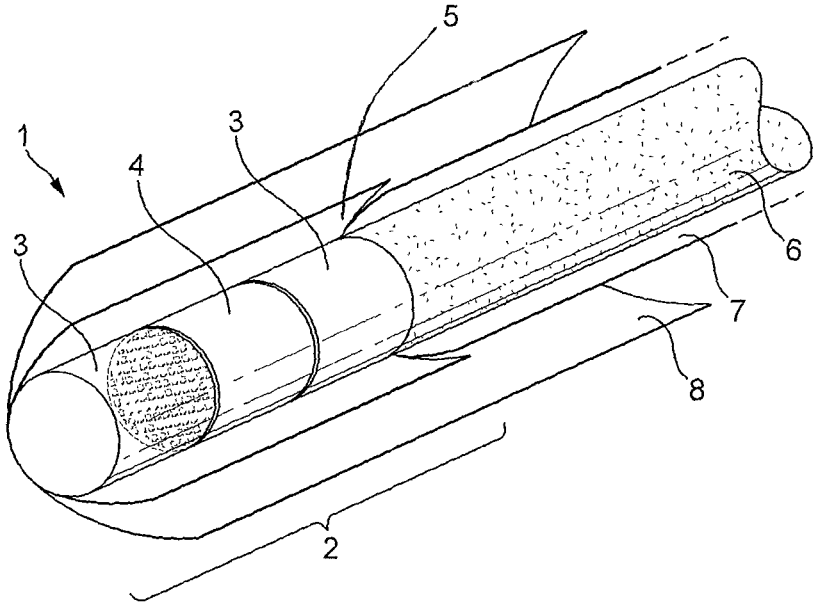
FIG. 1 is a diagram of a filter cigarette comprising a smoking article filter in accordance with the present disclosure (not to scale).

FIG. 1 shows a smoking article 1 comprising a smoking article filter 2. The smoking article filter 2 is a triple filter and comprises two sections of substantially cylindrical filter plug 3, separated by a monolith 4. The sections of filter plug 3 and monolith 4 are combined to form the smoking article filter 2 by means of a plugwrap 5.

The smoking article further comprises a cylindrical rod of smokeable material 6, in this case tobacco, aligned with the filter 2 such that the end of the smokeable material rod 6 abuts the end of the filter 2. The rod 6 is wrapped in a paper wrapper 7, and is joined to the filter 2 by tipping paper 8

In the embodiment shown in FIG. 1, the filter 2 is an integral part of the smoking article 1. However, in use or prior to use, the disclosed smoking article filters may alternatively be separate from the smoking article with which they are to be used. For example, the filter may form part of a smoking article holder such as a cigarette holder, or the filter may be incorporated into a smoking article such as a roll-your-own cigarette by the user prior to use.

Smoking Article Filters Comprising Multiple Monoliths

The use of multiple monoliths, such as, for example 2, 3, or 4 monoliths arranged longitudinally within the smoking article filter, may improve the adsorption of smoke components because the turbulence of the air being drawn through is increased relative to a single monolith of equivalent length. Increased turbulence results in greater interaction between the smoke and the carbon material of the monolith and therefore greater adsorption of smoke constituents.

It may also be advantageous to include a small gap, or a short section of filter material such as cellulose acetate, for example of about 0.5 mm to 5 mm, or from 1 mm to 2 mm in length, between the monoliths, to introduce further turbulence into the smoke.

Overview of Monolith Structure

Adsorbent carbon materials are usually provided in granular or particulate form. Monolithic carbon structures, or monoliths, however, are units of carbon which are not granular, but, in common with granular activated carbon, have a large surface area.

Figure 2:
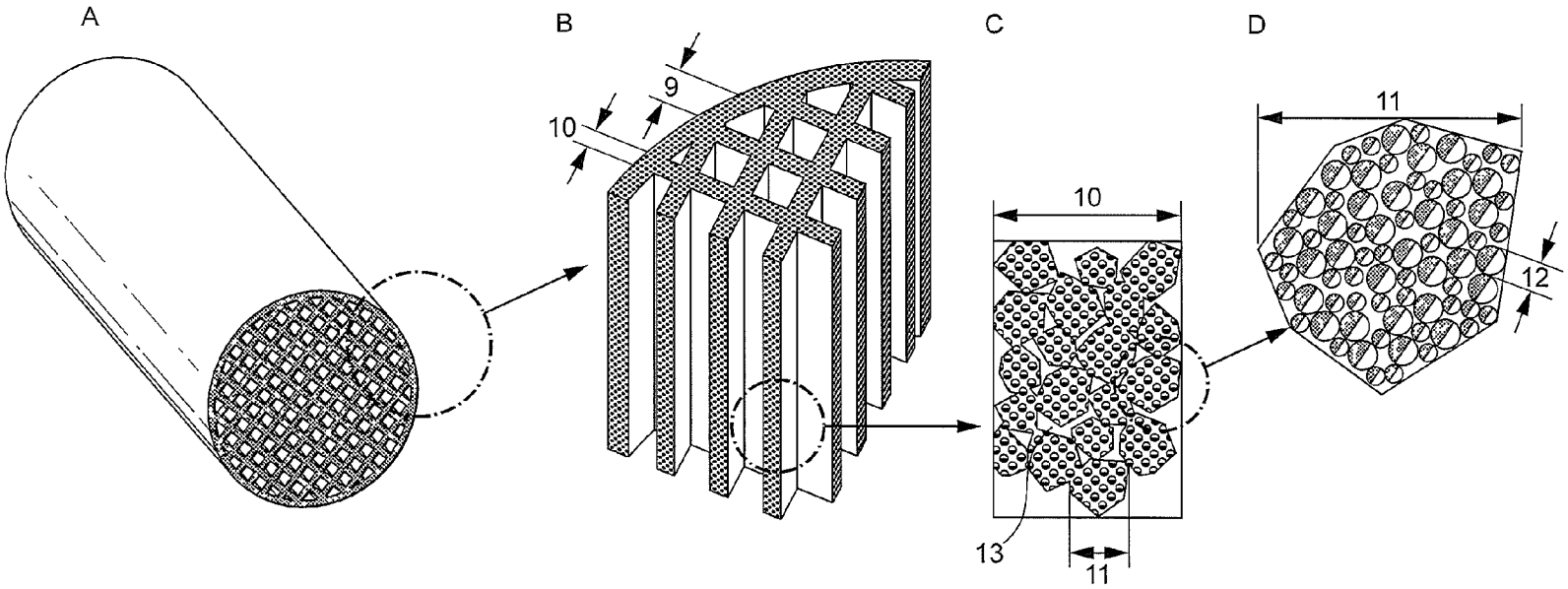
FIG. 2 is a diagram illustrating the structure of one embodiment of a monolith that may be used in the disclosed smoking article filters.

The disclosed monoliths have a unique structure, which makes them particularly suitable for use in smoking article filters. A diagram illustrating the structure of an example of a carbon monolith used in the disclosed smoking article filters is shown in FIG. 2. It can be seen that the monolith comprises a cylindrical activated carbon structure having numerous longitudinal channels 9. The walls 10 of the longitudinal channels in the monoliths comprise particles 11 forming a structure having micropores, macropores, and optionally, mesopores. As shown in FIG. 2C, these porous particles are bonded in such a way that they have macroporous spaces 13 between them. The particles 11 have a pore structure 12 which comprises micropores and optionally mesopores. The macropores 13 may facilitate the passage of gases from the longitudinal channels 9 into the porous domains 12 of the constituent particles.

In order to form this structure, the monoliths may be produced by partially curing an organic resin to a solid and then comminuting the partially cured resin to form small particles.

The resin particles of a selected size are then mixed with a liquid (which may be any liquid in which the resin is not soluble, such as water), and extrusion additives, to form a dough material.

The dough material is then formed into a monolith, for example by extrusion.

The monolith may then be dried, for example by being gently heated, to stabilise the structure.

The particles in the dried monolith are then sintered to bond them together, and thereby form a solid sintered resin monolith. By this stage the resin may be fully cured.

The sintered monolith may then be carbonized and activated as required to increase the surface area and pore volume of the material, and provide the desired pore structure.

Finally, the carbonized sintered monolith may be incorporated into a smoking article filter, for example, for use in a smoking article.

Certain of these steps, such as extrusion and sintering, or drying, sintering and carbonization, or sintering, carbonization and activation, or carbonization and activation, may be combined and performed as part of the same process step.

Of particular importance in the method of production is that the resin is cured to the correct degree. The resin should be cured sufficiently that it does not melt during subsequent carbonization. However, it should not be cured so much that it is incapable of being sintered. In one example, pressure applied to the particles during extrusion results in the sintering of the particles. When sintered, the particles fuse together to form a solid product, but importantly, they do not melt or lose porosity during this process.

Monoliths have previously been produced from porous resin particles which are then fused using a separately introduced binder, such as a second uncured resin, for example. However, the introduction of a binder at this stage may result in the loss of some or all of the porosity of the particles, which are necessarily coated in the binder in order to become bonded. In contrast, in the production of the disclosed monoliths, the macroporous structure can be maintained, and micropores, and optionally mesopores, can be introduced into the material. Furthermore, greater control over the fine structure of the monoliths is provided by the method disclosed herein. For example, the porosity of the particles can be adjusted in the final monolith structure with a greater degree of accuracy. In addition, the structure of the monolith comprises numerous macropores 13 between the particles, and the extent of these macropores may be controlled by the size of the particles. This level of regulation is not possible when a separately introduced binder is used, which leads to an increased density of the channel walls with significantly reduced macropores and less flexibility in monolith design.

The channels 9 of the monolith may be of any cross-sectional shape, such as, for example, square, hexagonal, triangular, or circular. Considerations regarding the shape of the channel are that the channels should be convenient to produce by extrusion, for example, the dies should be relatively simple to produce. In addition, the walls of the channels should provide the monolith with good mechanical strength and consistent wall thickness. Generally, square channels are used.

Optimising the Monolith Structure

It may be desirable for the monolith to be optimised to operate under specific smoking conditions. For example, it may be desirable for the monolith to adsorb specific smoke analytes, to provide a minimum pressure drop, or to function well under an intense smoking regime. There are a number of variables that may be adjusted to optimise the monolith for use in a smoking article filter and the properties of the disclosed monolith may easily be adjusted accordingly by the skilled person.

In common with conventional granular activated carbon, the pore structure of the particles 11, the surface chemistry, the surface area, and the proportion of the pore volume present in micro-, meso-, and/or macropores are all important in controlling the capacity of the material to adsorb different substances. These properties are provided by the constituent particles and the subsequent carbonization and activation steps. Advantageously, due to the fact that the monolith is formed by sintering rather than by the use of, for example, techniques which significantly melt the particles or use a binder, the properties of the particles will not be significantly altered as a result of the processing steps employed for production of the monolith. Consequently, as a result of their method of production, the disclosed monoliths have properties that are advantageously both predictable and highly reproducible.

The spaces 13 between the particles provide macropores in the carbonized monolith. The size of the macropores may be controlled by adjusting the size of the particles which, when close packed, provide a macropore size which is approximately 20% of the size of the precursor particles. Larger macropores are formed when larger particles are used, and the relationship between the size of the particles used and the size of the macropores in the resultant monolith is linear.

The size of the macropores may be reduced by introducing a proportion of small particles, which will naturally occupy the spaces between the larger particles.

The size of the macropores may be increased by the use of void formers. In this case, particulate void formers such as polystyrene are incorporated into the sintered monolith, but are completely vapourised when the monolith is carbonized and/or activated, producing large macropores.

The length of monolith may also be easily adjusted. An advantageous property of monoliths is that their length may be increased without significantly increasing the pressure drop of the filter. This means that more adsorptive material may be added without detriment to the smoking experience. In contrast, the amount of granular activated carbon that can be used in a filter is limited by the pressure drop effect.

Monoliths for use in the disclosed smoking article filters may comprise a number of internal channels which extend alongside each other in a generally longitudinal direction through the monolith. The diameter of the longitudinal channels 9 and the thickness of the channel walls 10 are further variables which may be adjusted to optimise the monolith for use in smoke filtration.

The channels are formed in the monolith by means of an extrusion process using a suitable die. In this way, the channels are formed in the monolith and extend throughout the length of the monolith. Throughout the specification, the channels are described as "longitudinal" and are said to extend throughout the "length" of the monolith, and these terms are to be understood in terms of the extrusion method of production of the monolith. In other words, the longitudinal direction is the direction of extrusion, and this dimension is considered to be the length of the monolith, even though this may not be the longest dimension.

Since they are produced by means of an extrusion process, the channels are macroscopic and not microscopic in size. In particular, the diameter of the longitudinal channels may be 225-600 μm, and is preferably 310-500 μm. Monoliths having these channel diameters are advantageous for engineering reasons in that these channel dimensions are optimal for production by the disclosed extrusion methods, and also because if the channels are too narrow the draw strength may be too high, and if the channels are too wide this can weaken the structure.

In transverse cross section, each channel of the monolith and its associated boundary walls is revealed as a 'cell'. One 'unit cell' 14 is defined as the distance between the centres of the two opposite walls of a longitudinal channel when viewed in transverse cross section. The unit cell is therefore a function of both the wall thickness 10 and the channel width 9. This feature of monoliths is termed the 'cell geometry', and is illustrated in FIG. 3A.

One variable of the cell geometry which may be adjusted is the 'open area'. The 'open area' is the combined cross sectional surface area of the channels as a proportion of the total cross sectional surface area of the monolith. In terms of cell geometry, the open area of a unit cell is the proportion of the total surface area of the cell occupied by the lumenal area of the channel.

Figure 3:
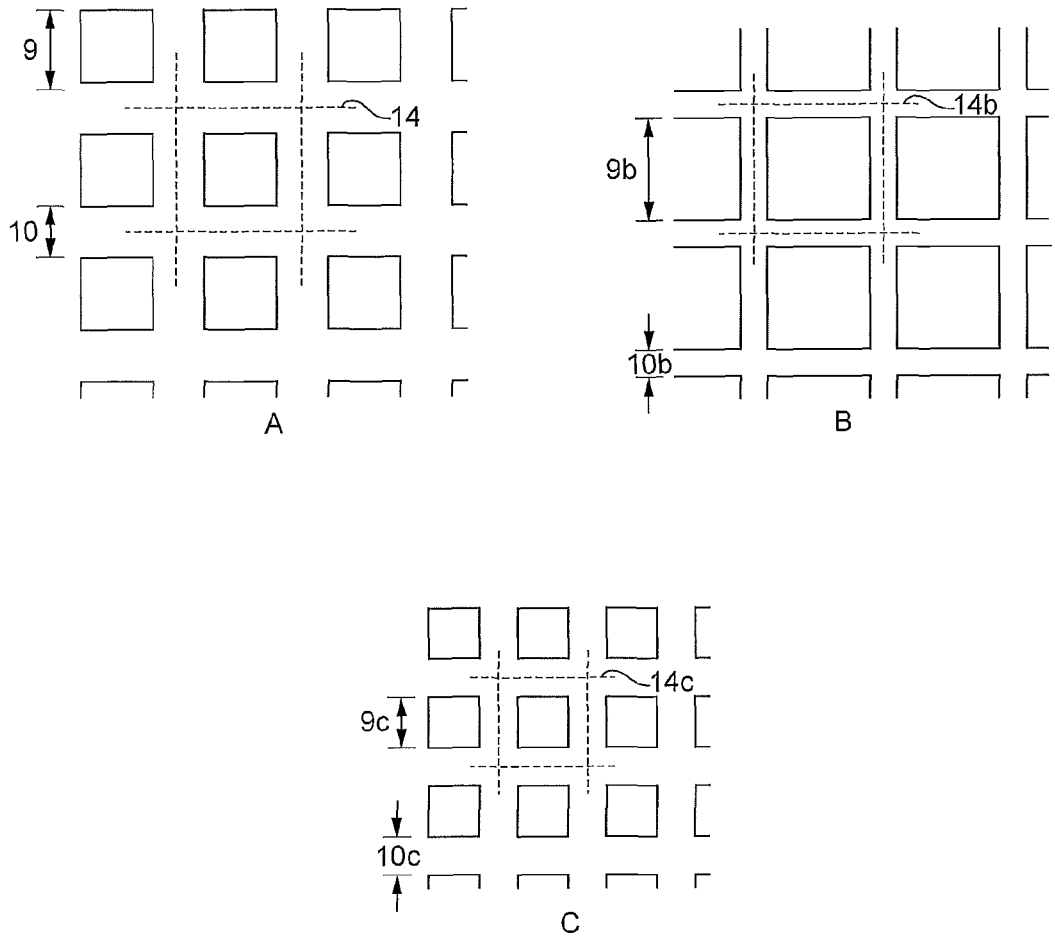
FIG. 3 is a diagram illustrating the cell geometry of a monolith of the type shown in FIG. 2.

This is illustrated in FIG. 3B, in which the size of the unit cell 14*b* is kept constant relative to the configuration shown in FIG. 3A, but the channel diameter 9*b* is increased at the expense of the wall thickness 10*b*. In this way the surface area of the carbon material available for adsorption within each unit cell, and therefore in the monolith as a whole, is reduced. There is also a reduction in the amount of activated carbon material used, and the mechanical strength of the monolith. Adjusting the open area of a monolith may influence the resistance to draw when the smoking article filter is in use.

There is a limit to how thin the channel walls 10 may be before the mechanical strength of the monolith or, potentially, that of the extrusion die used to produce the monolith, becomes insufficient. In general, it is considered that the wall thickness should be no less than an order of magnitude greater than the size of the constituent particles. In general, the ratio of wall thickness to particle size is about 10:1, or may be 15:1, 20:1, 25:1, or 50:1.

A second variable of the cell geometry which may be adjusted is the channel density. The smaller the unit cell, the greater is the channel density of the monolith. This is illustrated in FIG. 3C in which the size of the unit cell 14*c* is reduced relative to the configuration shown in FIG. 3A, whilst the ratio of channel diameter 9*c* to wall thickness 10*c* is maintained.

As a consequence of the method of production involving careful control of the degree of curing followed by subsequent extrusion and sintering, the cell geometry of the disclosed monoliths may be easily manipulated. As the skilled person will appreciate, adjusting the cell geometry requires the use of a different die during the extrusion process. Since the properties of the material are determined by the constituent particles and sintering conditions, and are not in this case altered by, for example, the addition of a binder, the skilled person may manipulate the cell geometry, pore structure, and surface chemistry of the monolith cheaply and in a highly predictable and reproducible manner.

Monoliths generally have an approximately cylindrical configuration. Non-cylindrical monoliths may also be used. For example, monoliths may be oval, triangular, square, pentagonal, hexagonal, or octagonal in cross section.

The diameter of the monolith may be dependent on the diameter of the smoking article filter in which the monolith is to be used. For example, the diameter may be substantially the same or slightly smaller than that of the smoking article filter in which the monolith is to be used.

The monolith may in addition, or as an alternative, comprise channels which are external to the monolith, and are not entirely longitudinally encompassed by the material of the monolith.

Figure 4:
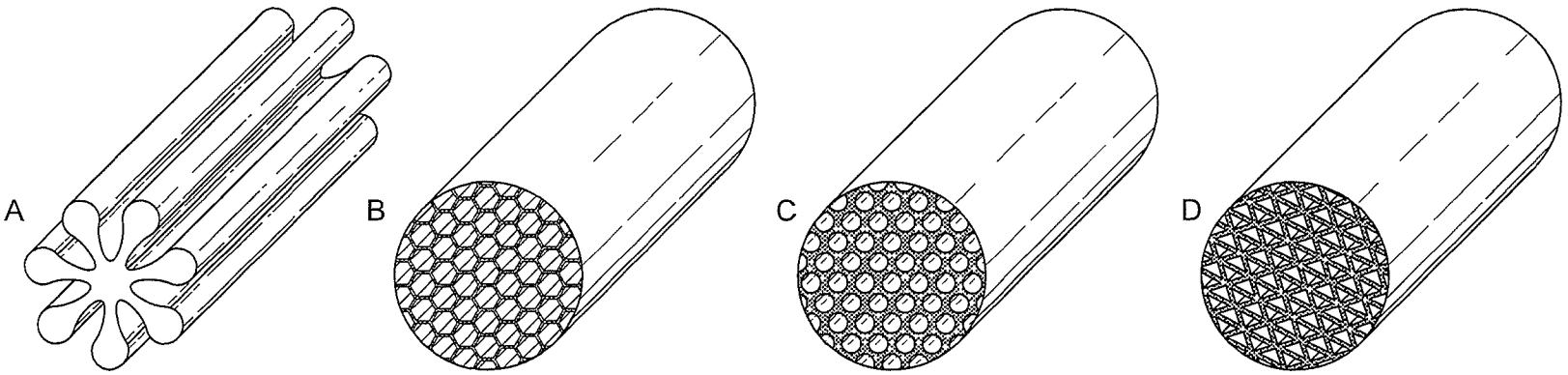
FIG. 4 is a diagram illustrating example monolith configurations for use in smoking article filters, for example, of the type shown in FIG. 1.

External channels may, for example, take the form of ridges or grooves in the external surface of the monolith, as shown in FIG. 4A. Monoliths having external channels may be substantially non-cylindrical, or they may have a shape which is substantially cylindrical.

External channels may have any cross sectional shape, which may be a regular or irregular shape. For example, the external channels may be U-shaped or V-shaped.

Alternatively, the external surface of the monolith may contain no external channels.

In use in a smoking article filter, smoke may be drawn between the external surface of the monolith channel and the inner face of the plugwrap of the smoking article filter.

Monolith Carbon Material

In this patent specification, and in accordance with nomenclature used by those skilled in the art, pores in an adsorbent material are called "micropores" if their pore size is less than 2 nm ($<2\times10^{-9}$ m) in diameter, "mesopores" if their pore size is in the range 2-50 nm, and "macropores" if their pore size exceeds 50 nm. Pores having diameters greater than 500 nm do not usually contribute significantly to the adsorbency of porous materials.

In relation to the disclosed monoliths, the term "macropores" refers to the spaces formed between the particles.

The term "channels" refers to the longitudinal channels within the monolith, which are visible to the naked eye and are formed by the extrusion die. The channels may be 225-600 μm in width, preferably 310-500 μm in width, and are generally greater than 250 μm in width. The skilled person would not consider the channels to be macropores, even though the channel dimensions may fall within the size definition of macropores given above.

"Micropores", and when present "mesopores", may be formed within the sintered particles when the monoliths are carbonized and activated.

The relative volumes of micropores, mesopores and macropores in a porous material can be estimated using well-known nitrogen adsorption and mercury porosimetry techniques. Mercury porosimetry can be used to estimate the volume of macro- and mesopores; nitrogen adsorption can be used to estimate the volumes of micro- and mesopores, using the so-called BJH mathematical model. However, since the theoretical bases for the estimations are different, the values obtained by the two methods cannot be compared directly with each other.

Surface areas of porous materials can be estimated by measuring the variation of the volume of nitrogen adsorbed by the material with partial pressure of nitrogen at a constant temperature. Analysis of the results by mathematical models originated by Brunauer, Emmett and Teller results in a value known as the BET surface area. In this specification, unless otherwise indicated, all surface area data is as measured by nitrogen adsorption.

Porous carbon materials characterised by a combination of physical properties have been found to be particularly effective in reducing one or more components from tobacco smoke. Monoliths of the disclosed smoking article filters may comprise carbon material having this advantageous combination of properties.

In particular, the monoliths may comprise porous carbon materials having a BET surface area of at least 800 $m^2/g$, a density of 0.4 to 1.0 g/cc, a pore structure that includes mesopores and micropores, and a pore volume (as measured by nitrogen adsorption) of 0.4 to 1.5 $cm^3/g$.

The monolith carbon materials may also be characterised by their pore structure rather than density. In particular, the monoliths may comprise porous carbon materials having a BET surface area of at least 800 $m^2/g$, a pore structure that includes mesopores and micropores, and a pore volume (as measured by nitrogen adsorption) of at least 0.4 to 1.5 $cm^3/g$, from 15 to 65% of which is in mesopores.

The density and pore structure of porous carbon material are closely related. Generally, the greater is the combined volume of micro-, meso- and macropores, the lower the density. This is because pores increase the volume of a given mass of material without increasing its weight. Furthermore, as the density decreases, so the proportion of macro- and mesopores to micropores increases. That is to say, in general, the lower the density of the carbon material, the higher the proportion of the pore volume in mesopores and macropores compared with the pore volume in micropores. However the correlation between density and pore volume, as determined by nitrogen adsorption, is not precise.

A lack of complete correlation between density and micro- and mesopore structure arises because the technique of nitrogen adsorption used to estimate pore size distribution is not capable of detecting pore sizes greater than about 50 nm. The total pore volume of a material estimated by nitrogen adsorption techniques therefore corresponds to the combined pore volumes of micropores and mesopores. The macropore volume of a material is not revealed by this technique. Thus, where carbon materials have a low density and a relatively low proportion of mesopores, as detected by nitrogen adsorption, the low density is attributable to a relatively high pore volume in the macropore range immediately neighbouring mesopore range, i.e. in the range 50 nm to 500 nm. Whilst pore volumes in the macropore range can be estimated by mercury porosimetry, the results obtained using this technique do not match those obtained using nitrogen adsorption. Hence it is difficult to estimate precisely the pore volume of a material across the full range of pore sizes from 2-500 nm.

Some monolith carbon materials may have a density which is greater than 0.4, 0.5, or 0.6 g/cc. Some monolith carbon materials may have densities less than 0.7, 0.8, or 0.9 g/cc.

The BET surface area of the material may vary. Usually, the surface area of the material will lie within a range, the upper and lower limits of which are defined by any two of the following values that differ from each other, namely 2100, 2000, 1800, 1750, 1600, 1500, 1300, 1100, 1010, 1000, 950, 910, 900, 810, 790, and 700 $m^2/g$.

For example, the material may have a surface area of from 700 to 2000 $m^2/g$, from 700 to 1300 $m^2/g$, from 790 to 1100 $m^2/g$, from 810 to 1010 $m^2/g$, from 790 to 1800 $m^2/g$, from 810 to 1300 $m^2/g$, etc.

The porous carbon materials of the monoliths of the disclosed smoking article filters generally have a pore volume (as estimated by nitrogen adsorption) of 0.4 to 1.5 $cm^3/g$. Pore volumes of monolith carbon materials comprising micropores and mesopores are greater than those of monolith carbon materials which are exclusively microporous. The pore volume of suitable monolith carbon materials may be greater than 0.5, 0.6, 0.7, or 0.8 $cm^3/g$, and may be less than 1.4, 1.3, 1.2, or 1.1 $cm^3/g$.

In the monolith porous carbon materials, from 25% to 65%, such as for example, 40%, of the pore volume (as estimated by nitrogen adsorption) may be in mesopores. For example, minimum values for the volume of mesopores as a percentage of the combined micropore and mesopore volumes of the carbon materials of the invention may be 27, 30, 35, 37, 40, or 45%. Maximum values for such volumes may be 65, 60, 55, and 53%. Generally, the mesopore volume of the monolith carbon materials may be in the range 35-55% of the combined mesopore and micropore volume. In particular, by adjusting the pore size distribution, specific removal of certain smoke analytes may be improved.

Raw Material

The carbon materials of the monoliths for use in the disclosed smoking article filters are derived from resins. The resins may be obtained by condensing a nucleophilic component with an electrophilic cross-linking agent, optionally in the presence of a pore former.

The nucleophilic component may be, for example, a phenolic resin, such as a novolak resin, or another resin based upon copolymers of phenolic compounds, such as m-aminophenol, diphenols such as resorcinol, hydroquinone, or amines such as aniline, melamine or urea with aldehydes such as formaldehyde, furfural or salicylaldehyde.

The cross linking agent may be, for example, formaldehyde, furfural or hexamethylenetetramine.

The condensation is initially carried out to produce a partially condensed product. The condensation may be carried out so as to produce a Novolak resin which is only curable when an additional cross-linking agent is mixed with it.

The resins for use in producing the monolithic activated carbon structures of the invention are generally novolak resins cross-linked with hexamethylene tetramine.

Pore Former

The condensation of the nucleophilic component with the electrophilic cross linking agent may be performed in the presence of a pore former. A pore former is particularly useful for incorporating larger pores into the material.

A solvent may also be used in the production of the resin. The pore former may act as a solvent.

There are a large number of solvents that can be employed as pore formers. These solvents should have a viscosity that is not too high, and a boiling temperature that is sufficiently high to allow the polycondensation reaction to proceed at a reasonable rate without significant solvent evaporation. The novolak resin and the cross linking agent should also have a high solubility in the solvent.

The pore former may be, for example, a diol, a diol-ether, a cyclic ester, a substituted cyclic or linear amide or an amino alcohol.

Ethylene glycol and diethylene glycol may be used as pore formers.

In general, the greater the pore former content, the larger the pores produced and the higher the pore volume. Thus, this mechanism provides a convenient method of controlling the larger pore development in the cross-linked resin.

The weight ratio of pore former to the components of the resin system is generally at least 1:1. The cross-linking agent is normally used in an amount of from 5 to 40 parts by weight (pbw) per 100 parts by weight of the nucleophilic components, typically from 5 to 15, for example 10 pbw cross-linking agent per 100 pbw of nucleophilic component.

Curing

As described above, control of the degree of curing of the resin is important. In particular, the resin cure should be controlled so that it is sufficient to prevent the resin melting during subsequent carbonization, but low enough that the particles produced during the comminution step can sinter during subsequent processing.

Generally the temperature and duration of the partial curing step is selected to give a degree of cure sufficient to give a product that is both capable of being comminuted to provide particles of the desired size, and wherein the resulting particles are capable of being sintered.

The degree of curing may be assessed from the crush strength of a 3 mm extrudate prepared from particles of the cured resin. Generally, in the case of phenolic resins, the pellet after carbonization has a radial crush strength measured with a conventional device for determining the crush strength of catalyst supports, of 5 kg.

Comminution

Once cured to the desired extent, the resin is comminuted prior to formation of the monolithic structure.

The skilled person will be aware that various methods of comminution will be suitable to provide the resin material particles of the correct characteristics. In general, comminution may be performed by any suitable method, which may include grinding, milling, pounding, compaction, pulverisation or any other means of reducing solid matter into small fragments. For example, a jet mill incorporating a classifier may be used, whereby the particles are reduced in size in a high energy fluid bed and only particles of less than a predetermined size are allowed to leave the mill.

Following comminution, comminuted resin particles having an optimal size may be selected. Size selection may be by any suitable method, for example, by sieving of the comminuted material. Alternatively, a milling process designed to produce particles of the correct size without the need for sieving can be used.

The mean particle size of the comminuted material may be in the range of 1-200 μm, such as 5-100 μm. For example, the mean particle size is less than 70 μm and is generally about 10-60 μm.

Extrusion

The extrusion process may be performed by any suitable method, and various methods will be known to the skilled person.

To improve the extrusion process, the comminuted resin particles may be formed into a suitable dough material. For example, the resin particles may be mixed with extrusion additives and a liquid in which the resin particles are insoluble, such as water. Other additives known to people skilled in the art may also be used.

Sintering

The disclosed monolith is a sintered monolith. "Sintered" refers to the process in which the individual particles of partially cured resin are adhered together without significant melting or the need for a separately introduced binder, such as, for example, a second, uncured, resin.

As described above, it is an important feature of the sintering process that the resin particles substantially retain their physical properties during the sintering process. In particular, it is undesirable for the particles to melt and produce a molten mass of resin. This is because the particles, and more specifically the macropores between the particles, provide the internal porosity to the monolith structure. If the resin were to melt then the fine structure of the particles would be lost, and the resulting monolith structure would have fewer macropores. Melting may also cause distortion of the carbonized monolith.

The sintering process may result from the residual chemical activity of the resin particles when the curing process has been carried out to the correct extent such that the particles are able to become chemically bonded together. This bonding process requires no heat or pressure, although it may be enhanced by both gentle heating and pressure, and may be facilitated by the presence of moisture. In the absence of moisture, higher temperatures and/or pressures may be required. The sintering process may be partly driven by the pressure involved in the extrusion process and also by the drying process which can either be at room temperature or slightly elevated temperatures, such as less than 100° C.

Drying

Following the extrusion process, a drying step is generally performed in order to remove liquid from the extruded monolithic structure. The monoliths may be dried at room temperature, and the drying process may be accelerated by gentle heating.

Carbonisation and Activation

Carbonisation may be achieved by heating the monolith structure in an inert atmosphere or vacuum, to a temperature of at least 600° C. Carbonisation is generally performed for approximately 1 hour, although the duration of the carbonization step is not critical.

Activation results from the heat treatment of the monolith structure in a reactive atmosphere. The monolith structures may be activated by heating in air, steam, or carbon dioxide, or in combinations of these gases, at temperatures of at least 400° C., 750° C. and 800° C. respectively. The activation is generally carried out in $CO_2$ at 800-1000° C. for 3-24 hours.

Activation and carbonization may be performed as part of the same process, for instance a process which heats the monoliths to a temperature at or above 800° C. and then back to ambient temperature, in one example over a time period of up to 24 hours.

The extent of the activation reaction is characterised by the burn-off as determined by the change in mass of the structure, expressed as a percentage weight loss of the carbonized material. Activation of the monolith structure improves the accessibility of the pore structure and can increase the pore width and pore volume if required. In general, increasing percentage activation results in a greater number of micropores and hence greater surface area.

Activation of the monolith structure may result in a carbon weight loss of 10-50%, such as 15-40%. Carbon weight loss values may be about 16-38%, 17-35%, 18-30%, or 20-25%.

Pore Size

The pore size distribution of the monolithic structure may be affected by a number of factors, including the nature of the electrophilic component and the cross-linking agents used, the presence of a pore former, and the reaction rate.

Separation of the carbon material from the pore former at low temperatures prior to carbonization, for example, by washing or vacuum drying, also affects the pore size distribution. Carbon materials that have been treated to remove the pore former before carbonization have higher mesopore volumes than similar materials in which the pore former is driven off during carbonization.

The pore structure of the monoliths may be manipulated depending on the particular substances to be adsorbed.

In general, as shown in FIG. 2, micro- and/or mesoporosity 12 predominantly results from the resin precursor material. This pore structure may be manipulated by the use of a pore former, and/or by adjusting the carbonization and activation conditions.

In contrast, the size of the micropores may be adjusted by varying the size of the precursor particles, and typically, the macropore size is approximately 20% of the resin particle size.

Cells

As described above, the monoliths comprise a number of longitudinal channels, or 'cells'. The number of cells within the monolith may vary. The number of cells may lie within a range, the upper and lower limits of which are defined by any two of the following values that differ from each other, namely 75, 90, 120, 150, 180, 200, 220, 250, 280, and 310 cells per square centimeter.

For example, the number of cells per square centimeter may be from 180 to 310, and is preferably from 200 to 280.

Alternatively, the cell structure of the monoliths may be defined in terms of the open area. The open area of the monolith may vary. The open area may lie within a range, the upper and lower limits of which are defined by any two of the following values that differ from each other, namely 25, 30, 35, 40, 45, 50, 55, 60, 65, 70, 75, and 80%.

For example, the open area may be from 30 to 60%, preferably from 30 to 40%, and more preferably from 32 to 38%, such as about 35%.

The cells of the monoliths shown in FIGS. 1 and 2 are square in cross section. However, cells having any cross-sectional shape may be used. For example, as shown in FIGS. 4B, C, and D, the channels may be hexagonal, circular, or triangular. The channels may have more complex cross sectional shapes, which may be regular or irregular shapes. Cells at the periphery of the monolith may be irregularly shaped due to being truncated by the external wall of the monolith. Square cells may provide a good balance between minimising the problems associated with the manufacture of the extrusion die, ease of extrusion, and adsorption and mechanical properties of the produced carbon monolith.

Site

The size of the monolith may be determined by the intended use. For example, monoliths for inclusion in cigarette filters may be generally cylindrical, and have a similar circumference to the circumference of the cigarette. A typical cigarette diameter is about 8 mm, and therefore a monolith for use in such a filter will have a diameter slightly smaller than this, such as for example, 7.8 mm Monoliths for use in other smoking articles may have different circumferences accordingly.

The length of the monolith may be limited in practice by the length of the smoking article filter. Therefore, the monoliths may have a length of about 4 mm or 5 mm to about 27 mm, generally the monoliths are from about 6 to 25 mm, 7 and 23 mm, or 8 and 21 mm in length, for example, the monoliths may be from about 8 mm to about 12 mm, such as about 10 mm, in length.

Additive

An additive may be added to, and carried by, the monolith. The additive may be anything which may be added to smoke and which may modify the composition of smoke. The additive may be a deodoriser, a diluent, an adsorbent, or any other substance that is capable of modifying the smoke. The additive may be water. Where local regulations permit, the additive may be a flavourant, such as menthol.

The additive may be carried within the pores and/or the channels of the monolith and may be released as smoke is drawn through the monolith. The additive may be released by any suitable means, for example, the temperature, pH, moisture content, or other property of the smoke may induce the release of the additive.

As used herein, the term "flavour", "flavouring", and "flavourant" refer to materials which, where local regulations permit, may be used to create a desired taste or aroma. Flavourants include extracts (e.g., licorice, hydrangea, Japanese white bark magnolia leaf, chamomile, fenugreek, clove, menthol, Japanese mint, aniseed, cinnamon, herb, wintergreen, cherry, berry, peach, apple, Drambuie, bourbon, scotch, whiskey, spearmint, peppermint, lavender, cardamon, celery, cascarilla, nutmeg, sandalwood, bergamot, geranium, honey essence, rose oil, vanilla, lemon oil, orange oil, *cassia*, caraway, cognac, jasmine, ylang-ylang, sage, fennel, piment, ginger, anise, coriander, coffee, or a mint oil from any species of the genus *Mentha*), flavour masking agents, bitterness receptor site blockers, receptor site enhancers, sweeteners (e.g., sucralose, acesulfame potassium, aspartame, saccharine, cyclamates, lactose, sucrose, glucose, fructose, sorbitol, or mannitol), and other additives such as chlorophyll, minerals, botanicals, or breath freshening agents. They may be imitation, synthetic or natural ingredients or blends thereof.

The flavour may be a tobacco flavour, for example, derived from tobacco extract.

The additive may be a solid, such as a powder, a liquid, such as a liquid flavourant, deodoriser, water, etc, or a gas, such as an aromatic composition.

EXAMPLES

Sample Preparation and Methods of Analysis

WO 03/008068 gives details of methods of producing monoliths comprising carbonized sintered resin.

Unless otherwise stated, all of the monoliths described in the Examples comprise carbonized sintered resin, and have a BET surface area of about 900 $m^2/g$. All of the monoliths had an open area of 36%.

In order to determine the performance of various activated carbon samples in the removal of smoke analytes from tobacco smoke, test cigarettes were manufactured comprising various samples of activated carbon. For each cigarette a three-part filter was assembled in which the mouth-end and tobacco-end segments were comprised of plugs of cellulose acetate having 10% and 6% triacetin respectively. Within the central cavity was inserted the activated carbon sample such as the monolith or granular carbon as applicable. For comparison, control cigarettes were also prepared wherein the central filter section was an empty cavity.

The filter assemblies were not ventilated.

Prior to smoking, the test and control cigarettes were stored for three weeks at 22° C. and 60% relative humidity.

The cigarettes were then machine smoked under controlled conditions (at 22° C. and 60% relative humidity), and the smoke drawn from each of the cigarettes was analysed to determine the level of different mainstream smoke analytes. Unless otherwise indicated, cigarettes were machine smoked under the ISO smoking regime with one 35 ml puff of 2 second duration being taken every minute.

The percentage reduction for each analyte in the smoke from the test cigarettes was then calculated by comparing it to the analyte yield from the control cigarette as follows:

$$\text{Percentage reduction of smoke analyte}=(A-B/A)\times 100$$

Where:

A=control cigarette smoke analyte yield (normalised to the NFDPM yield)

B=test cigarette smoke analyte yield (normalised to the NFDPM yield)

1. Effect of Monolith Channel Density

The effect of channel density on the ability of monoliths to adsorb smoke analytes was assessed.

Two monoliths comprising carbonized sintered resin were prepared, having different channel densities. The monoliths were prepared in an identical manner, the only difference being that the monoliths were extruded using different dies having different numbers of cells per square centimeter but a constant open area of 36%. The ratio of the wall thickness to channel diameter was kept constant. The porosities of the different monoliths were found to be substantially the same.

The lower channel density monolith had approximately 90 cells per square centimeter, and the higher channel density monolith had approximately 200 cells per square centimeter. Test cigarettes were prepared as described above and smoked under controlled conditions. Control cigarettes having an empty cavity in place of the monolith were produced and smoked under the same conditions. The percentage reduction in the level of each analyte was then calculated and is shown in Table 1.

TABLE 1

| | Percentage Smoke Analyte Reductions | |
|---|---|---|
| | 90 cells/cm$^2$ | 200 cells/cm$^2$ |
| Hydrogen Cyanide | 71 | 87 |
| 1,3-Butadiene | 56 | 81 |
| Isoprene | 72 | 86 |
| Acrylonitrile | 70 | 85 |
| Benzene | 72 | 84 |
| Toluene | 73 | 72 |
| Mean % Reduction | 69 | 83 |

There was a discernable increase in the adsorption of all of the analytes measured when the channel density was increased from 90 cells to 200 cells per square centimeter.

2. Effect of Monolith Length at High Cell Density

The effect of monolith length on the ability to adsorb smoke analytes was assessed.

Two monoliths comprising carbonized sintered resin having approximately 200 cells per square centimeter, and an open area of 36% were prepared, having lengths of 5 mm and 10 mm respectively. The monoliths were prepared in an identical manner, the only difference being that the lengths of the monoliths were adjusted by adjusting the extrusion conditions.

Test cigarettes were prepared as described previously and smoked under controlled conditions. Control cigarettes having an empty cavity in place of the monolith were produced and smoked under the same conditions. Two control cigarettes were produced, having a cavity length of 5 mm and 10 mm respectively.

The performance of each of the test cigarettes was then assessed relative to the control cigarette having the corresponding length cavity. The smoke analyte yield was determined and is shown in Table 2.

TABLE 2

| | Smoke Analyte Yield | | | |
|---|---|---|---|---|
| | 5 mm | | 10 mm | |
| | Cavity | Monolith | Cavity | Monolith |
| Hydrogen Cyanide (μg) | 161 | 63.1 | 166 | 22.3 |
| 1,3 Butadiene (μg) | 35.3 | 17.8 | 37.6 | 7.15 |
| Isoprene (μg) | 315 | 129 | 324 | 44.5 |
| Acrylonitrile (μg) | 14.4 | 4.64 | 15.9 | 2.38 |
| Benzene (μg) | 42.5 | 17.1 | 45.9 | 7.15 |
| Toluene (μg) | 77.8 | 36.4 | 80.9 | 22.3 |

The percentage reduction in the level of each analyte was calculated and is shown in Table 3.

TABLE 3

| | Percentage Smoke Analyte Reductions | |
|---|---|---|
| | 5 mm | 10 mm |
| Hydrogen Cyanide | 61 | 87 |
| 1,3 Butadiene | 50 | 81 |
| Isoprene | 59 | 86 |
| Acrylonitrile | 68 | 85 |
| Benzene | 60 | 84 |
| Toluene | 53 | 72 |
| Mean % Reduction | 58 | 83 |

Increasing the length of the monolith resulted in a greater adsorption of smoke analytes for all analytes tested.

3. Effect of Multiple Monoliths

The effect of multiple monoliths on the ability to adsorb smoke analytes was assessed.

Two monoliths comprising carbonized sintered resin were prepared, having lengths of 10 mm and 5 mm respectively. The monoliths were prepared in an identical manner, the only difference being that the lengths of the monoliths were adjusted by cutting to the appropriate length prior to carbonization and activation.

Test cigarettes were prepared as described previously having one 10 mm monolith, or two adjacent 5 mm monoliths. The cigarettes were smoked under controlled ISO conditions. A control cigarette having an empty 10 mm cavity in place of the monolith were produced and smoked under the same conditions.

The performance of each of the cigarettes was then assessed. The smoke analyte yield was determined and is shown in Table 4.

TABLE 4

| | Smoke Analyte Yield | | |
|---|---|---|---|
| | 10 mm Cavity | 1 × 10 mm | 2 × 5 mm |
| Formaldehyde (μg) | 62.3 | 33 | 27.9 |
| Acetaldehyde (μg) | 532 | 190 | 118 |
| Acetone (μg) | 259 | 78.9 | 42.5 |
| Acrolein (μg) | 79.9 | 20.5 | 10.9 |
| Propionaldehyde (μg) | 51.8 | 18.5 | 10.1 |
| Crotonaldehyde (μg) | 19 | 5.31 | 3.07 |
| Methyl Ethyl Ketone (μg) | 60.7 | 20.5 | 12 |
| Butyraldehyde (μg) | 34.8 | 11.2 | 5.92 |
| Hydrogen Cyanide (μg) | 177 | 58.8 | 45.5 |
| 1,3 Butadiene (μg) | 33.2 | 14.1 | 6.68 |
| Isoprene (μg) | 270 | 105 | 45.8 |
| Acrylonitrile (μg) | 11.8 | 2.98 | 2.22 |
| Benzene (μg) | 41.3 | 16.3 | 11.1 |
| Toluene (μg) | 76 | 38.4 | 36.2 |

The percentage reduction in the level of each analyte was calculated and is shown in Table 5.

TABLE 5

| | Percentage Smoke Analyte Reductions | |
|---|---|---|
| | 1 × 10 mm | 2 × 5 mm |
| Formaldehyde (μg) | 47 | 55 |
| Acetaldehyde (μg) | 64 | 78 |
| Acetone (μg) | 69 | 84 |
| Acrolein (μg) | 74 | 86 |
| Propionaldehyde (μg) | 64 | 80 |
| Crotonaldehyde (μg) | 72 | 84 |
| Methyl Ethyl Ketone (μg) | 66 | 80 |
| Butyraldehyde (μg) | 68 | 83 |
| Hydrogen Cyanide (μg) | 67 | 74 |
| 1,3 Butadiene (μg) | 57 | 80 |
| Isoprene (μg) | 61 | 83 |
| Acrylonitrile (μg) | 75 | 81 |
| Benzene (μg) | 60 | 73 |
| Toluene (μg) | 49 | 52 |
| Mean % Reduction | 64 | 77 |

It was demonstrated in Example 2 that increasing the length of the monolith resulted in a greater adsorption of smoke analytes. However, Example 3 clearly indicates that using two adjacent shorter monoliths in combination increased the percentage smoke analyte reduction in comparison to a single monolith of the same total length.

4. Effect of Smoking Intensity

The ability of monoliths to adsorb smoke analytes versus conventional granular activated carbon under conditions of different smoking intensity was tested.

Monoliths comprising carbonized sintered resin were prepared, having lengths of 10 mm, and having approximately 200 cells per square centimeter, and an open area of 36%. Control cigarettes were also prepared containing no filter additive (i.e. with an empty cavity).

Cigarettes were also prepared comprising granular activated carbon in the central filter section in place of the monolith. In order that the physical properties of the granular carbon were as similar as possible to those of the monolith carbon, the granular carbon was produced from the same particulate material, and was extruded to form a rod, in an identical manner to the production of the monolith. The rod of granular carbon was then pulverised to form granular activated carbon which was inserted into the cigarette filter cavity.

Two well-known industry standard smoking regimes were used in the controlled smoking of the cigarettes.

Under the 'ISO' regime, the cigarettes were machine smoked with one 35 ml puff of 2 second duration being taken every minute.

The 'Intense' smoking regime (which is considered to be more representative of the way in which people smoke), was also performed, in accordance with conditions defined by the Canadian Government in its Tobacco Act Reporting Regulation for cigarette products. According to this Intense smoking regime, the cigarettes were machine smoked with one 55 ml puff of 2 second duration being taken every 30 seconds.

The smoke analyte yield was determined and is shown in Table 6.

TABLE 6

| | Smoke Analyte Yield | | | | | |
|---|---|---|---|---|---|---|
| | ISO | | | Intense | | |
| | Cavity | Monolith | Granular | Cavity | Monolith | Granular |
| Acetaldehyde (μg) | 541 1 | 119 5 | 201 5 | 1061.4 | 461.9 | 773.8 |
| Acetone (μg) | 268.5 | 35.3 | 44 | 527 4 | 154 2 | 228 6 |
| Acrolein (μg) | 75.2 | 9.3 | 11.7 | 145 3 | 39 | 59 8 |
| Butyraldehyde (μg) | 36 8 | 7 8 | 6 3 | 82.2 | 25.5 | 27.8 |
| Crotonaldehyde (μg) | 22 | 1.8 | 1 7 | 54 2 | 12 | 9 4 |
| Formaldehyde (μg) | 41 8 | 19 1 | 16.2 | 96.8 | 39.7 | 40.4 |
| Methyl Ethyl Ketone (μg) | 65 6 | 8 1 | 7.5 | 137 | 37.8 | 36.9 |
| Propronaldehyde (μg) | 45.5 | 6 4 | 8 6 | 91 3 | 28 3 | 42 1 |

The percentage reduction in the level of each analyte was calculated and is shown in Table 7.

TABLE 7

| | Percentage Smoke Analyte Reductions | | | |
|---|---|---|---|---|
| | Granular | | Monolith | |
| | ISO | Intense | ISO | Intense |
| Acetaldehyde | 63 | 27 | 78 | 56 |
| Acetone | 84 | 57 | 87 | 71 |
| Acrolein | 84 | 59 | 88 | 73 |
| Butyraldehyde | 83 | 66 | 79 | 69 |
| Crotonaldehyde | 92 | 83 | 92 | 78 |
| Formaldehyde | 61 | 58 | 54 | 59 |
| Methyl Ethyl Ketone | 89 | 73 | 88 | 72 |
| Propionaldehyde | 81 | 54 | 86 | 69 |
| Mean % Reduction | 80 | 60 | 81 | 68 |

The capacity of the monolith and granular activated carbon to adsorb smoke analytes was similar when cigarettes were smoke under ISO conditions. However, under the Intense regime, the monolith performed significantly better than granular activated carbon.

The ability of the monolith to retain a high capacity to adsorb smoke analytes under an Intense smoking regime is surprising. This is an important observation because the efficacy of conventional filters to remove smoke analytes is reduced as the user draws with greater intensity on the smoking article. This clearly results in the inhalation of an increased concentration of smoke analytes. However, by using a filter comprising a monolith the user will not be exposed to an increased concentration of smoke analytes regardless of the intensity of the draw.

This property is clearly a result of the monolithic structure because the activated carbon material was identical in the granular and monolithic samples. Presumably the property arises as a result of the available surface area and pore size distribution provided by the wall structure and cell geometry of the monolith. The cellular structure of the monolith presumably facilitates access of smoke analytes to sites of adsorption, even when they are drawn across the material with a high velocity.

5. Effect of the Introduction of Mesopores

The effect of pore structure on the ability of monoliths to adsorb smoke analytes was investigated.

Monoliths of 10 mm in length, comprising carbonized sintered resin, and having approximately 200 cells per square centimeter, and an open area of 36% were prepared. The monoliths were either microporous, or were both microporous and mesoporous. Mesopores were introduced into the resin by means of a pore former.

Figure 5:
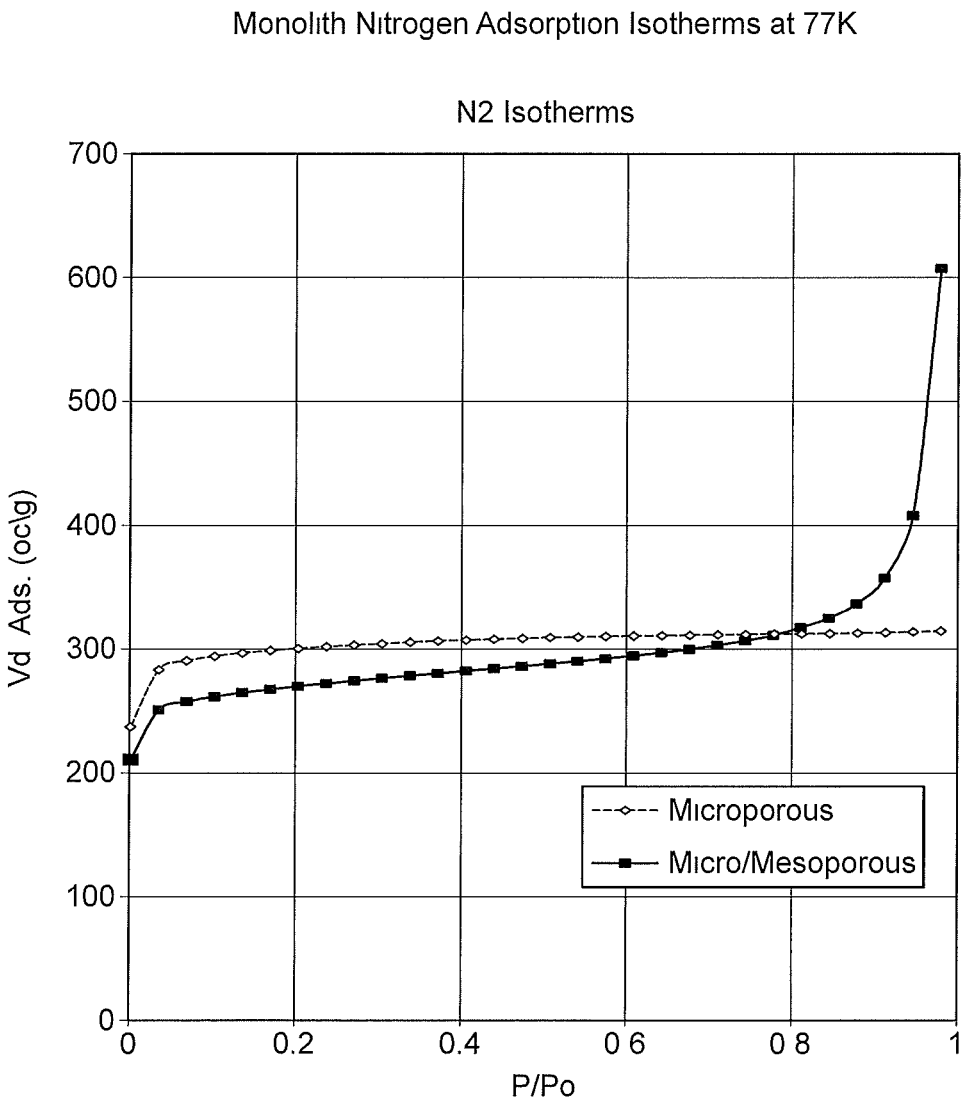
FIG. 5 shows the sorption isotherms of two activated carbon monoliths capable of use in smoking article filters.

The porosities of the monoliths were confirmed using nitrogen adsorption at 77K, and the resulting sorption isotherms are shown in FIG. 5. As the skilled person would be aware, a sharp 'knee' in the isotherms at low relative pressures indicated that micropores were present. An upward curvature at higher relative pressures is indicative of the presence of mesopores. FIG. 5 therefore confirms the presence of mesopores in one of the monoliths but not in the other.

Two non-monolithic samples of activated carbon material were also used for comparison. The first granular activated carbon was a coconut-based microporous activated carbon obtained from Sutcliffe Speakman (208C), comprising granules having a mesh size of 15/40. The second granular activated carbon was a microporous and mesoporous synthetic activated carbon obtained from MAST Carbon Ltd (BW), comprising carbon beads having a mesh size of 35/60.

The physical properties of the various samples of activated carbon are given in Table 8.

TABLE 8

| Form | Porosity | Surface Area ($m^2/g$) | Pore Volume ($cm^3/g$) |
|---|---|---|---|
| Granular | Microporous | 900 | 0.45 |
| | Microporous & Mesoporous | 1300 | 1.08 |
| Monolith | Microporous | 900 | 0.49 |
| | Microporous & Mesoporous | 810 | 0.94 |

The percentage smoke analyte reductions under ISO and Intense smoking conditions are shown in Table 9.

TABLE 9

| | Percentage Smoke Analyte Reductions | | | | | | | |
|---|---|---|---|---|---|---|---|---|
| | Granular | | | | Monolith | | | |
| | Micropores | | Micropores & mesopores | | Micropores | | Micropores & mesopores | |
| | ISO | Intense | ISO | Intense | ISO | Intense | ISO | Intense |
| Acetaldehyde | 33 | 12 | 51 | 6 | 67 | 55 | 57 | 41 |
| Acetone | 43 | 30 | 89 | 42 | 73 | 64 | 66 | 66 |
| Acrolein | 45 | 34 | 94 | 54 | 75 | 69 | 68 | 70 |
| Butyraldehyde | 43 | 40 | 94 | 77 | 71 | 64 | 67 | 73 |
| Crotonaldehyde | 55 | 55 | 90 | 93 | 77 | 69 | 72 | 77 |
| Formaldehyde | 32 | 35 | 68 | 70 | 40 | 48 | 50 | 58 |
| Methyl Ethyl Ketone | 48 | 41 | 96 | 83 | 74 | 66 | 69 | 74 |
| Propronaldehyde | 42 | 29 | 90 | 50 | 74 | 64 | 67 | 67 |
| 1,3 Butadiene | 21 | 11 | 59 | −0.9 | 66 | 52 | 61 | 45 |
| Isoprene | 41 | 18 | 100 | 49 | 79 | 60 | 69 | 63 |
| Acrylonitiile | 46 | 32 | 92 | 49 | 75 | 66 | 59 | 62 |
| Benzene | 44 | 31 | 97 | 88 | 70 | 62 | 62 | 68 |
| Toluene | 43 | 40 | 97 | 98 | 63 | 64 | 57 | 71 |
| Mean % Reduction | 41 | 31 | 86 | 58 | 69 | 62 | 63 | 64 |

The granular microporous activated carbon generally demonstrated the lowest adsorption of analytes under both the ISO and Intense smoking regimes.

It appears from a comparison of the granular carbon samples that the incorporation of mesopores into activated carbon improves the adsorption of analytes from tobacco smoke. This is true regardless of the intensity of the smoking regime.

Incorporation of mesopores does not, however, have this effect on the capacity of monoliths to adsorb smoke analytes. Indeed, under ISO conditions, the microporous monolith demonstrates a greater percentage smoke analyte reduction for 12 of the 13 smoke analytes measured when compared to the monolith comprising both micropores and mesopores.

The ability of carbon additives to adsorb various smoke analytes is normally adversely affected by the increased flow rates in the filter when moving from ISO to a more intensive smoking regime. This is thought to be because increasing the mainstream smoke flow rate through the filter decreases the contact time between smoke analytes and the carbon surface area, reducing the possibility of adsorption. It has been shown in Example 4 that the capacity of monoliths to adsorb smoke analytes is not as significantly diminished under increased smoking intensity as that of conventional granular activated carbons. As expected, the granular activated carbon samples demonstrate significantly reduced percentage smoke analyte reductions at the Intense smoking regime compared to the ISO conditions. The microporous monolith shows a slight reduction in adsorption of analytes under intense smoking.

Remarkably, however, the monolith comprising both micropores and mesopores demonstrated comparatively far fewer distinguishable differences between ISO and intense percentage reductions for almost all of the smoke analytes measured. This property of a monolith having a structure comprising both micropores and mesopores to adsorb analytes with similar or better efficiency under the Intense regime is unexpected.

This ability does not appear to be a consequence of the monolith structure per se, because the effect is not as significant with the microporous monolith.

Furthermore, the effect does not appear to be a consequence of the presence of mesopores, since the same effect is not observed when the two granular carbon samples are compared. In this case, the introduction of mesopores appears to have no effect on the reduced adsorption of smoke analytes that occurs under the intense regime.

Rather, the effect appears to be a surprising and advantageous consequence of the combination of monolithic structure and a pore structure that is both microporous and mesoporous.

The invention claimed is:

1. A smoking article filter comprising a monolith circumscribed by a plugwrap, wherein the monolith comprises carbonized sintered resin and is configured such that a pressure drop of the filter does not significantly increase with monolith length.

2. The smoking article filter as claimed in claim 1, wherein the monolith does not comprise resin particles bound together using a binder.

3. A smoking article filter comprising a monolith circumscribed by a plugwrap, wherein the monolith comprises a plurality of cells, each cell comprising a channel that extends through the monolith, the combined cross sectional surface area of the channels comprising 30-40% of the total cross sectional surface area of the monolith, and the monolith configured such that a pressure drop of the filter does not significantly increase with monolith length.

4. The smoking article filter as claimed in claim 3, wherein the combined cross sectional surface area of the channels comprises 32-38% of the total cross sectional surface area of the monolith.

5. A smoking article filter, comprising: a monolith, the monolith configured such that a pressure drop of the filter does not significantly increase with monolith length, wherein the monolith comprises a plurality of cells, each cell comprising a channel that extends through the monolith, and wherein, in cross section, the monolith comprises 180-310 cells per square centimeter, and wherein the monolith has a pore volume of 0.4 to 1.5 $cm^3/g$ as estimated by nitrogen adsorption.

6. The smoking article filter according to claim 5, wherein, in cross section, the monolith comprises 200-280 cells per square centimeter.

7. The smoking article filter as claimed in claim 5, wherein the monolith comprises a carbon material having a pore structure that includes micropores and macropores.

8. The smoking article filter as claimed in claim 7, wherein the pore structure also includes mesopores.

9. The smoking article filter as claimed in claim 5, wherein the carbon material of the monolith encompassing the channels has a pore structure that includes macropores.

10. The smoking article filter as claimed in claim 5, wherein the monolith comprises channels that are square in cross section.

11. The smoking article filter as claimed in claim 5, wherein the carbon material of the monolith has a BET surface area of 700-1300 $m^2/g$.

12. The smoking article filter as claimed in claim 11, wherein the carbon material of the monolith has a BET surface area of 810-990 $m^2/g$.

13. The smoking article filter as claimed in claim 5, wherein the monolith is 8-12 mm in length.

14. The smoking article filter as claimed in claim 5, the smoking article filter comprising a plurality of monoliths.

15. A smoking article comprising the smoking article filter as claimed in claim 5.

16. The smoking article filter as claimed in claim 5, wherein the monolith comprises carbonized sintered resin.

17. The smoking article filter as claimed in claim 16, wherein the monolith does not comprise resin particles bound together using a binder.

18. The smoking article filter as claimed in claim 5, wherein the combined cross sectional surface area of the channels comprises 30-40% of the total cross sectional surface area of the monolith.

19. The smoking article filter as claimed in claim 18, wherein the combined cross sectional surface area of the channels comprises 32-38% of the total cross sectional surface area of the monolith.

20. A method of manufacturing a smoking article filter, comprising:

comminuting a partially cured resin to form particles of the partially cured resin;

forming particles of the partially cured resin into a dough and shaping the dough to produce a monolith;

sintering the particles of the monolith to form a sintered monolith;

carbonizing and activating the sintered monolith; and incorporating the activated sintered monolith into a smoking article filter configured such that a pressure drop of the filter does not significantly increase with monolith length.

21. The method as claimed in claim 20, wherein shaping the dough comprises extruding the dough.

22. The method as claimed in claim 20, wherein the dough is free from a binder.

23. The method as claimed in claim 20, wherein the resin is obtained by condensing a nucleophilic component with an electrophilic cross-linking agent in the presence of a pore former.

* * * * *